US007827654B2

(12) United States Patent
Nishikawa

(10) Patent No.: US 7,827,654 B2
(45) Date of Patent: Nov. 9, 2010

(54) SELF-TRAVELING CLEANER

(75) Inventor: Masato Nishikawa, Osaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 739 days.

(21) Appl. No.: 11/188,846

(22) Filed: Jul. 26, 2005

(65) Prior Publication Data

US 2006/0021168 A1 Feb. 2, 2006

(30) Foreign Application Priority Data

Jul. 29, 2004 (JP) ..... 2004-222340

(51) Int. Cl.
*A47L 9/00* (2006.01)
*A47L 9/04* (2006.01)

(52) U.S. Cl. ..... 15/385; 15/42; 15/363; 15/319

(58) Field of Classification Search ..... 15/385, 15/42, 390, 363–364, 371–372, 381–383, 15/319, 49.1, 41.1, 40, 78, 87, 39.5, 21.1
See application file for complete search history.

(56) References Cited

U.S. PATENT DOCUMENTS

| | | | | |
|---|---|---|---|---|
| 3,732,590 | A * | 5/1973 | Horst | 15/49.1 |
| 3,978,539 | A * | 9/1976 | Yonkers | 15/42 |
| 4,235,321 | A * | 11/1980 | Stein | 192/56.56 |
| 6,779,217 | B2 * | 8/2004 | Fisher | 15/98 |
| 6,883,201 | B2 * | 4/2005 | Jones et al. | 15/319 |
| 2004/0049877 | A1 | 3/2004 | Jones et al. | |

FOREIGN PATENT DOCUMENTS

| | | |
|---|---|---|
| JP | 62-292126 | 12/1987 |
| JP | 02-144030 A | 6/1990 |
| JP | 04-328607 A | 11/1992 |
| JP | 5-228090 | 9/1993 |
| JP | 7-32751 | 4/1995 |
| JP | 7-32752 | 4/1995 |
| JP | 7-322977 | 12/1995 |
| JP | 8-89453 | 4/1996 |
| JP | 2001-258806 | 9/2001 |
| JP | 2003-114719 | 4/2003 |
| JP | 2004-195215 | 7/2004 |
| JP | 2004-195215 A | 7/2004 |

OTHER PUBLICATIONS

Japanese Office Action dated Feb. 12, 2008 (mailing date), issued in corresponding Japanese Patent Application No. 2004-222340.
Chinese Office Action dated Nov. 21, 2008, Application No. 200510087432.1.

* cited by examiner

*Primary Examiner*—Laura C Guidotti
(74) *Attorney, Agent, or Firm*—Westerman, Hattori, Daniels & Adrian, LLP

(57) ABSTRACT

In a self-traveling cleaner of the present invention, a cleaning mechanism includes a brush mechanism rotatable along a floor surface and a driving mechanism for rotatingly driving the brush mechanism. The brush mechanism includes a rotation axis extending perpendicular to the floor surface, one arm projecting laterally from a lower end of the rotation axis, and a brush planted on the arm. The rotation axis is provided within a reverse side of the main body, and the arm has a rotation angle range in which the arm projects outwardly from an outer periphery of the main body and a rotation angle range in which the arm is contained within the outer periphery of the main body.

5 Claims, 7 Drawing Sheets

SELF-TRAVELING CLEANER

The priority application Number 2004-222340 upon which this patent application is based is hereby incorporated by reference.

BACKGROUND OF THE INVENTION

1. Field of the Invention

The present invention relates to a self-traveling cleaner that self-travels on a floor surface to clean the floor surface.

2. Description of Related Art

Various self-traveling cleaners have been conventionally proposed (see JP 2003-114719 A, JP 5-228090 A, JP 7-032752 B, JP 0.8-089453 A, JP 2001-258806 A, and JP 2004-195215 A). For example, a self-traveling cleaner shown in FIG. 8 includes a cylindrical main body 61 having a self-traveling mechanism including a pair of driving wheels 62, 62 and a pair of auxiliary wheels 63, 63, etc. and a cleaning mechanism including a circular rotary brush 7, etc. As shown in FIG. 9, the main body 61 includes a dust collector 74 having an inlet 75, and a driving mechanism including a driven pulley 71, a belt 72, and a driving pulley 73, to rotatingly drive the rotary brush 7.

In the above self-traveling cleaner, while the main body 61 travels along a wall surface 9 as shown in FIG. 8, the rotary brush 7 rotates to collect dust near the wall surface 9 into an inside of the main body 61. The collected dust is drawn into the dust collector 74 through the inlet 75 shown in FIG. 9.

However, the self-traveling cleaner with the rotary brush 7 is subjected to a great load by the floor surface with rotation of the rotary brush 7 because of a large contact area between the rotary brush 7 and the floor surface. This causes a drawback of a need for large power for rotatingly driving the rotary brush 7.

Accordingly, as shown in FIG. 10, there may be proposed a self-traveling cleaner including a brush mechanism 8 provided on a reverse side of the main body 61, the brush mechanism including a rotation axis 81, a pair of arms 82, 82 projecting in opposite directions from the rotation axis 81, and brushes 83, 83 each planted on an end portion of the arms 82, 82. The self-traveling cleaner is subjected to a smaller load from the floor surface with rotation of the brush mechanism 8 because of a smaller contact area between the brushes 83, 83 and the floor surface. Consequently, power may be smaller for rotatingly driving the brush mechanism 8.

However, in the self-traveling cleaner including the brush mechanism 8 including the brushes 83, 83 planted on the pair of arms 82, 82 as shown in FIG. 10, the brush mechanism 8 can entangle a power cord 91 during rotation of the brush mechanism 8 as shown in FIG. 11. If the cord 91 winds around the rotation axis 81 of the brush mechanism 8, even the rotation of the brush mechanism 8 cannot release the cord 91 and keeps the cord winding. Accordingly, the main body 61 self-travels dragging the cord 91, which can cause a problem of a difficulty in traveling.

SUMMARY OF THE INVENTION

An object of the present invention is to provide a self-traveling cleaner in which a brush mechanism is subjected to a small load by a floor surface, and the brush mechanism is prevented from entangling a cord or the like and interfering with self-travel.

A self-traveling cleaner of the present invention includes a main body having a self-traveling mechanism and a cleaning mechanism. The cleaning mechanism includes a brush mechanism rotatable along a floor surface and a driving mechanism for rotatingly driving the brush mechanism. The brush mechanism includes a rotation axis having a base end connected to the driving mechanism and extending perpendicular or approximately perpendicular to the floor surface, an arm projecting in one direction from a lower end of the rotation axis, and a brush planted on the arm.

Because the brush mechanism of the cleaning mechanism has the brush planted on the one arm, the above-described self-traveling cleaner of the present invention has a small contact area between the brush mechanism and the floor surface, and therefore is subjected to a small load by the floor surface. Furthermore, even if a cord is entangled during rotation of the brush mechanism, the arm reaches to a rotation angle posture where the entangled cord is released while rotating one round about the rotation axis by rotating by approximately 180 degrees from a rotation angle posture where the entangled cord is hooked. Thus, the cord is loosened from the arm with self-travel of the main body.

In a specific construction, the rotation axis (rotation shaft) of the brush mechanism is provided within a reverse side of the main body, and the arm of the brush mechanism has a first rotation angle range in which the arm projects outwardly from an outer periphery of the main body and a second rotation angle range in which the arm is contained within the outer periphery of the main body, the reverse side of the main body having an inlet of a dust collector. According to the specific construction, the brush projects outwardly from the main body to collect dust near a perpendicular wall, for example, while the arm rotates within the first rotation angle range, and the brush sweeps the collected dust toward the inlet of the dust collector while the arm rotates within the second rotation angle range.

In another specific construction, the arm of the brush mechanism is formed from an elastic material. According to the specific construction, if the arm entangles the cord and tension acts on the cord, the arm curves under the tension, and therefore the entangled cord can be easily released.

In still another specific construction, the driving mechanism has interposed on a power transmission path to the brush mechanism a slip mechanism for interrupting the power transmission path when an overload acts exceeding a load acting on the brush by the floor surface. According to the specific construction, if the arm of the brush mechanism entangles the cord and therefore the overload acts on the driving mechanism, the slip mechanism operates to interrupt the power transmission path of the driving mechanism, preventing a motor as a power source of the driving mechanism from being overloaded.

In still another specific construction, the rotation axis of the brush mechanism has the lower end having an opposed face to the floor surface formed with a curved surface convex toward the floor surface. According to the specific construction, when the arm releases the cord by rotating one round as described above in the case where the cord is entangled in the arm, the cord is guided by the convex surface formed on the lower end of the rotation axis and smoothly loosened from the arm. Furthermore, even if there is a step or the like on the floor surface, the lower end of the rotation axis is prevented from being caught by the step or the like thanks to the convex surface formed on the lower end.

As described above, according to the self-traveling cleaner of the present invention, the brush mechanism is subjected to a small load by a floor surface, and the brush mechanism is prevented from entangling a cord or the like and interfering with self-travel.

DETAILED DESCRIPTION OF THE INVENTION

Figure 1:
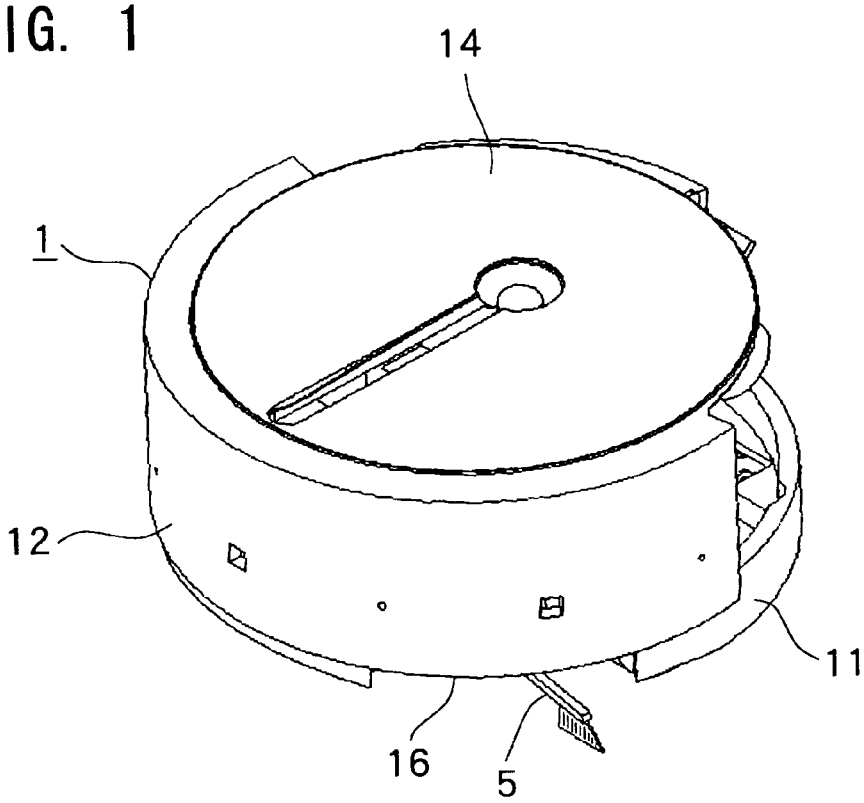
FIG. 1 is a perspective view showing an appearance of a self-traveling cleaner of the present invention.

An embodiment of the present invention will be described below in detail with reference to the drawings. As shown in FIG. 1, a self-traveling cleaner of the present invention includes a main body 1, which is cylindrical as a whole. An end portion of a brush mechanism 5 projects from an outer periphery of the main body 1.

Figure 2:
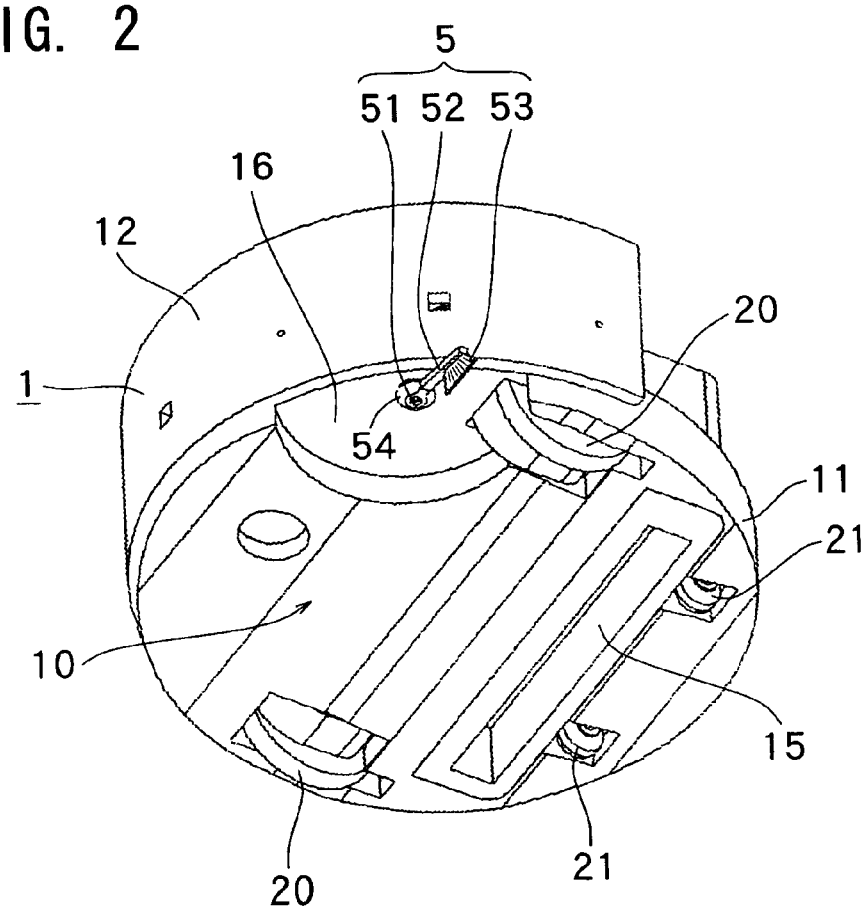
FIG. 2 is a perspective view of the self-traveling cleaner as seen from a reverse side.
Figure 3:
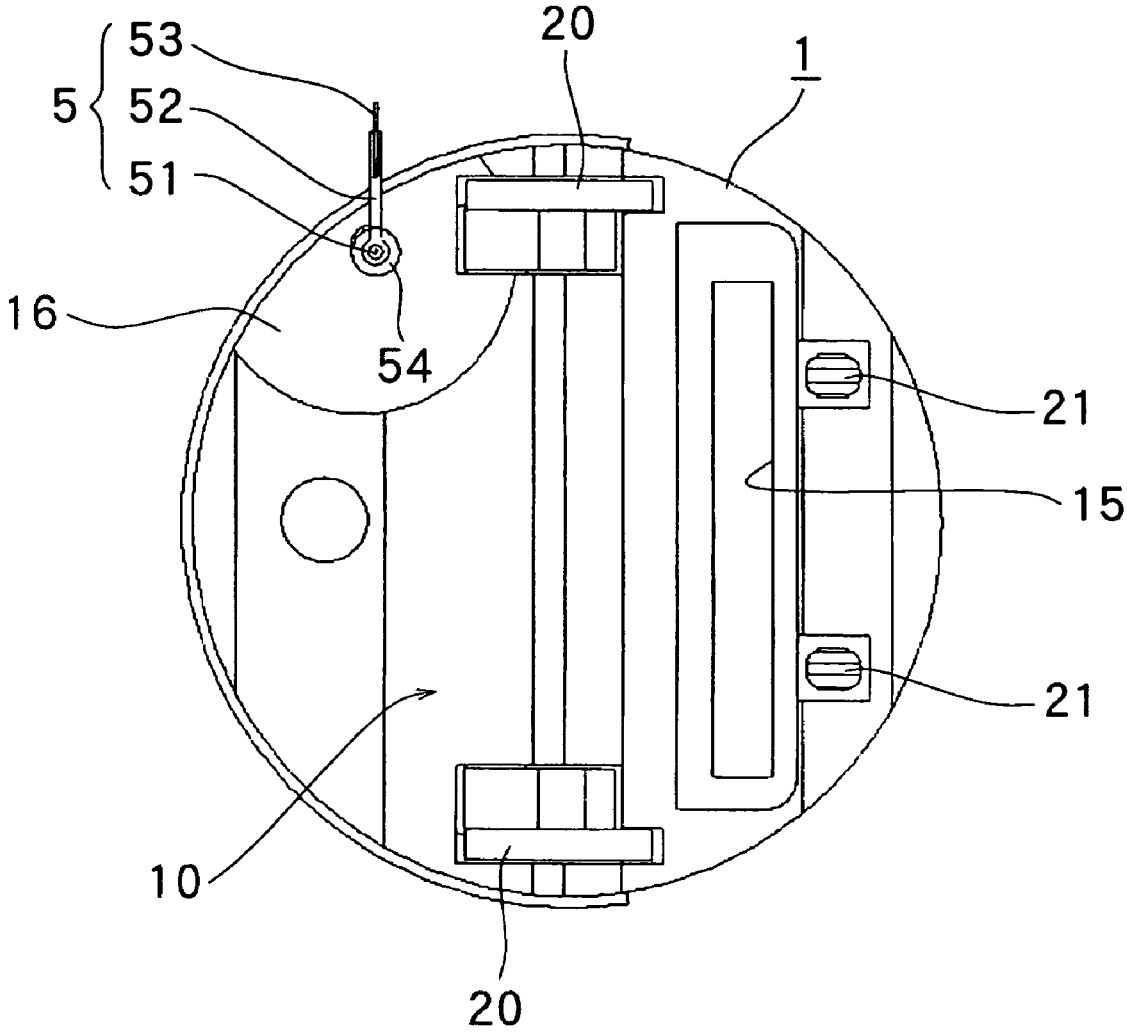
FIG. 3 is a reverse side view of the self-traveling cleaner.

As shown in FIGS. 2 and 3, the main body 1 has a reverse side 10 provided with a pair of driving wheels 20, 20 and a pair of auxiliary wheels 21, 21. The brush mechanism 5 is horizontally rotatably provided in a depression 16 formed on a part of the reverse side 10. An inlet 15 is further provided on the reverse side 10 of the main body 1.

The brush mechanism 5 includes a rotation axis 51 extending perpendicular to a floor surface, one arm 52 made of elastic resin projecting laterally from a lower end of the rotation shaft 51, and a brush 53 planted on an end portion of the arm 52 toward the floor surface. Furthermore, as shown in FIGS. 5 and 6, the rotation shaft 51 of the brush mechanism 5 has the lower end formed with a bowl-shaped curved surface 54 convex toward the floor surface and surrounding the rotation shaft 51.

Figure 4:
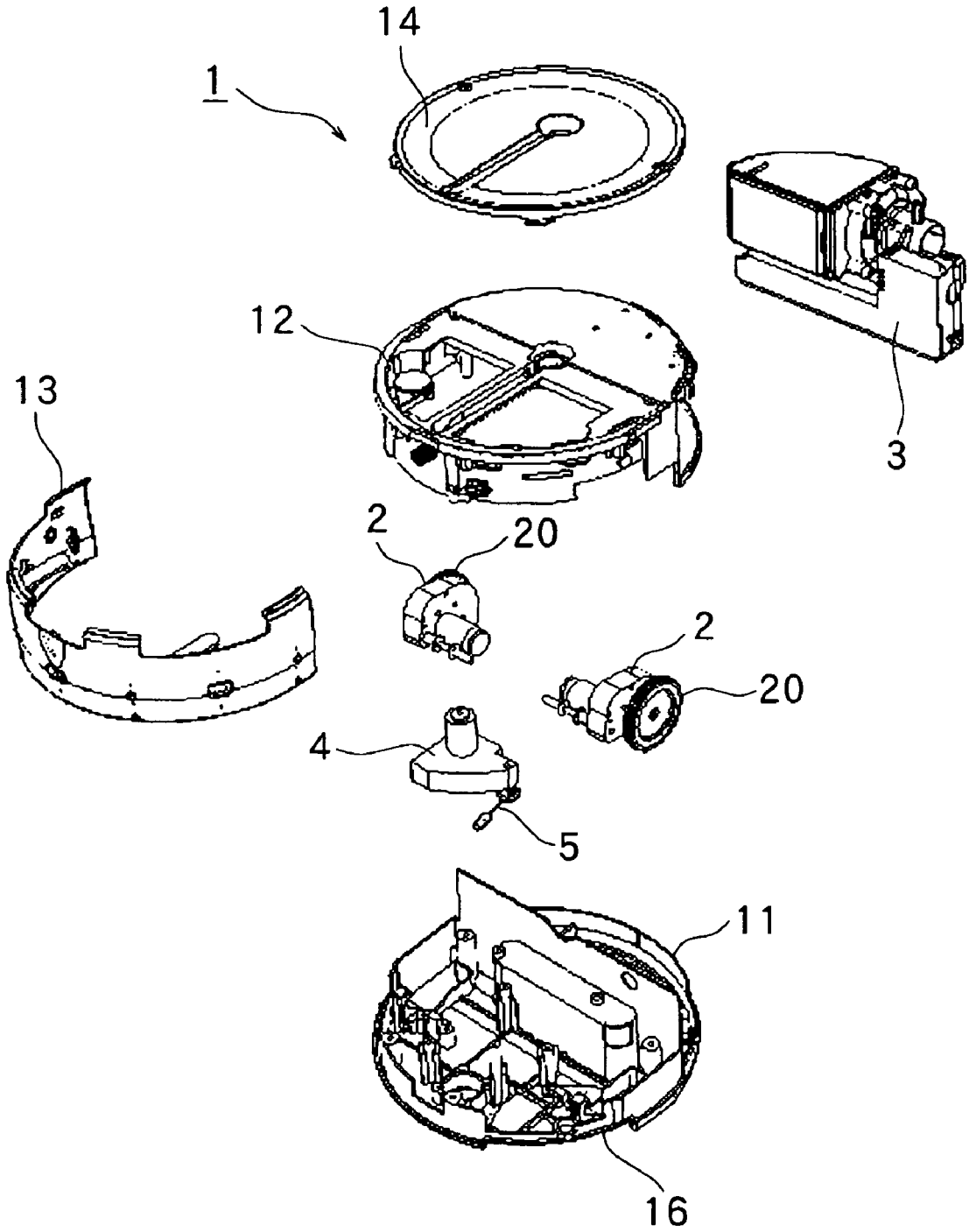
FIG. 4 is an exploded perspective view of the self-traveling cleaner.

As shown in FIG. 4, the main body 1 includes a circular base 11, a cylindrical frame 12 provided thereon, a circular cover 14 covering an upper surface of the frame 12, and a bumper 13 curved in a circular arc provided opposedly to an outer periphery of the frame 12. The main body 1 has mounted on the base 11 a right and left driving wheel units 2, 2 with the respective driving wheels 20, 20, the brush mechanism 5, a driving mechanism 4 driving the brush mechanism 5, and a dust collector 3. The dust collector 3 is connected to the inlet 15 provided on the base 11.

Figure 5:
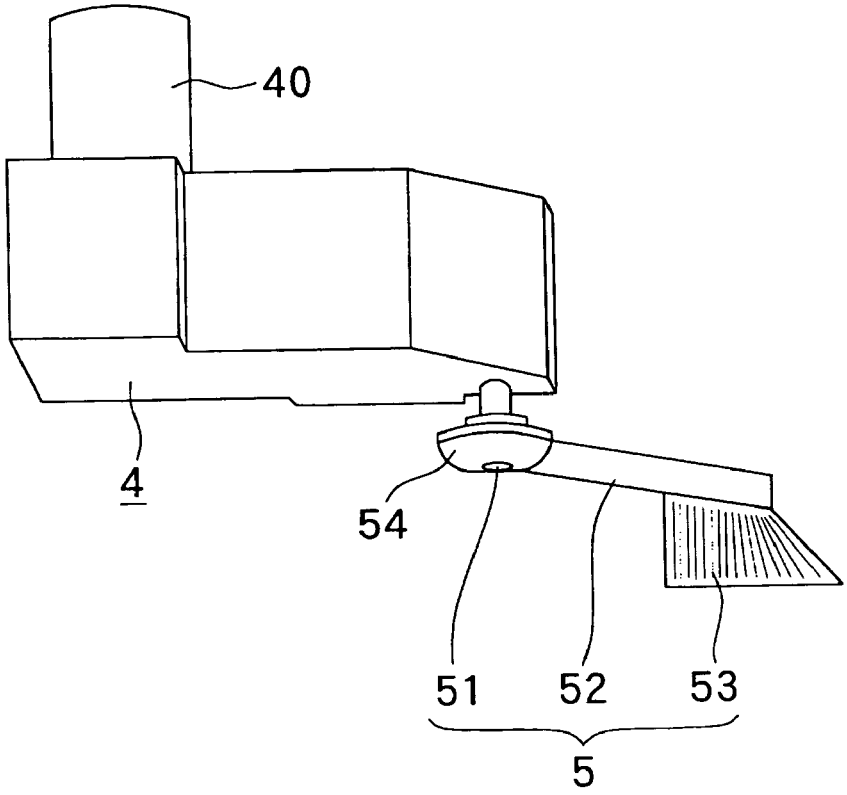
FIG. 5 is a perspective view of a brush mechanism and a driving mechanism.
Figure 6:
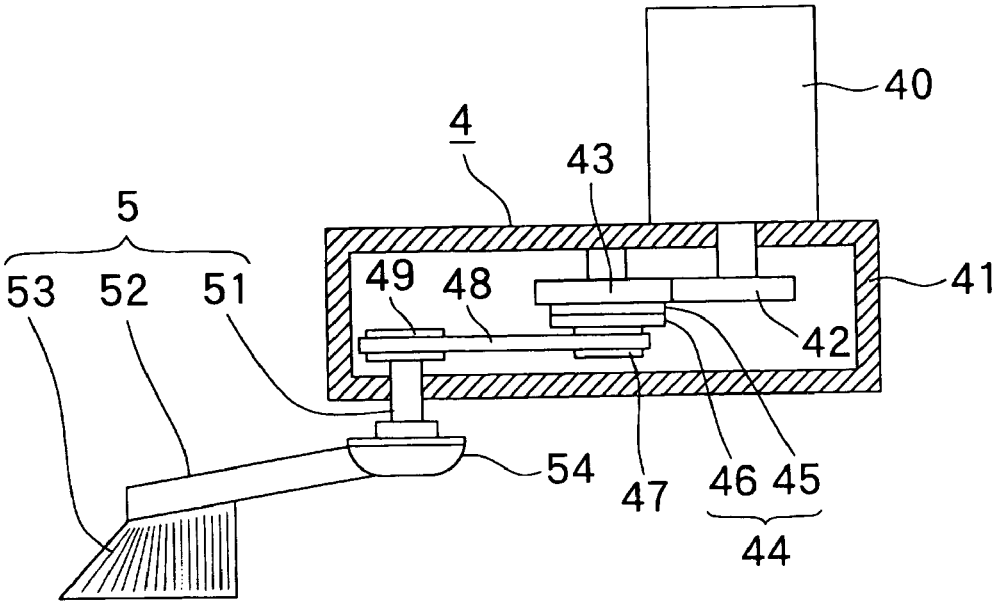
FIG. 6 is a partially broken side view of the brush mechanism and the driving mechanism.

As shown in FIG. 5, the brush mechanism 5 has the rotation shaft 51 connected to the driving, mechanism 4, and is horizontally rotatably driven by the driving mechanism 4. As shown in FIG. 6, the driving mechanism 4 has a motor 40 mounted on a housing 41. An output axis of the motor 40 is connected to the rotation axis 51 of the brush mechanism 5 via a power transmission path provided in the housing 41.

Specifically, a driving gear 42 is fixed in the housing 41 to the output axis of the motor 40. The driving gear 42 is in engagement with a driven gear 43 supported by the housing 41. A driving pulley 47 is attached to the driven gear 43 via a slip mechanism 44 including a first rotor 45 and a second rotor 46 frictionally engaging with each other. The first rotor 45 and the second rotor 46 of the slip mechanism 44 have respective frictionally engaging surfaces opposed to each other, and the frictionally engaging surfaces of the rotors 45, 46 are press-contacted to each other through a biasing means, which is not shown. The driving pulley 47 connects to a driven pulley 49 via a belt 48, and the rotation shaft 51 has an upper end connected and fixed to the driven pulley 49.

In the above-described driving mechanism 4, rotation of the motor 40 is transmitted to the rotation shaft 51 to rotatingly drive the brush mechanism 5 via the power transmission path including the driving gear 42, the driven gear 43, the slip mechanism 44, the driving pulley 47, the belt 48, and the driven pulley 49. Here, the brush 53 of the brush mechanism 5, which rotates sliding on the floor surface, is subjected to a load by the floor surface to some extent. However, power of the motor 40 is transmitted to the brush mechanism 5 via the slip mechanism 44 because the first rotor 45 and the second rotor 46 of the slip mechanism 44 are press-contacted to each other by bias of the biasing means and are in frictional engagement, to rotate the rotors 45, 46 integrally.

In the above-described self-traveling cleaner of the present invention, the arm 52 of the brush mechanism 5 has a first rotation angle range in which the arm projects outwardly from an outer periphery of the main body 1 and a second rotation angle range in which the arm is contained within the outer periphery of the main body 1. The brush 53 projects outwardly from the main body 1 to collect dust near a wall surface, for example, while the arm 52 rotates within the first rotation angle range, and the brush 53 sweeps the collected dust toward the inlet 15 while the arm 52 rotates within the second rotation angle range. Consequently, the dust is efficiently drawn into the dust collector 3, so that high dust collecting efficiency can be obtained.

Because the brush mechanism 5 has the brush 53 planted (or disposed) on the one arm 52, the above-described self-traveling cleaner of the present invention has a small contact area between the brush 53 and the floor surface, and therefore is subjected to a small load by the floor surface.

Figure 7:
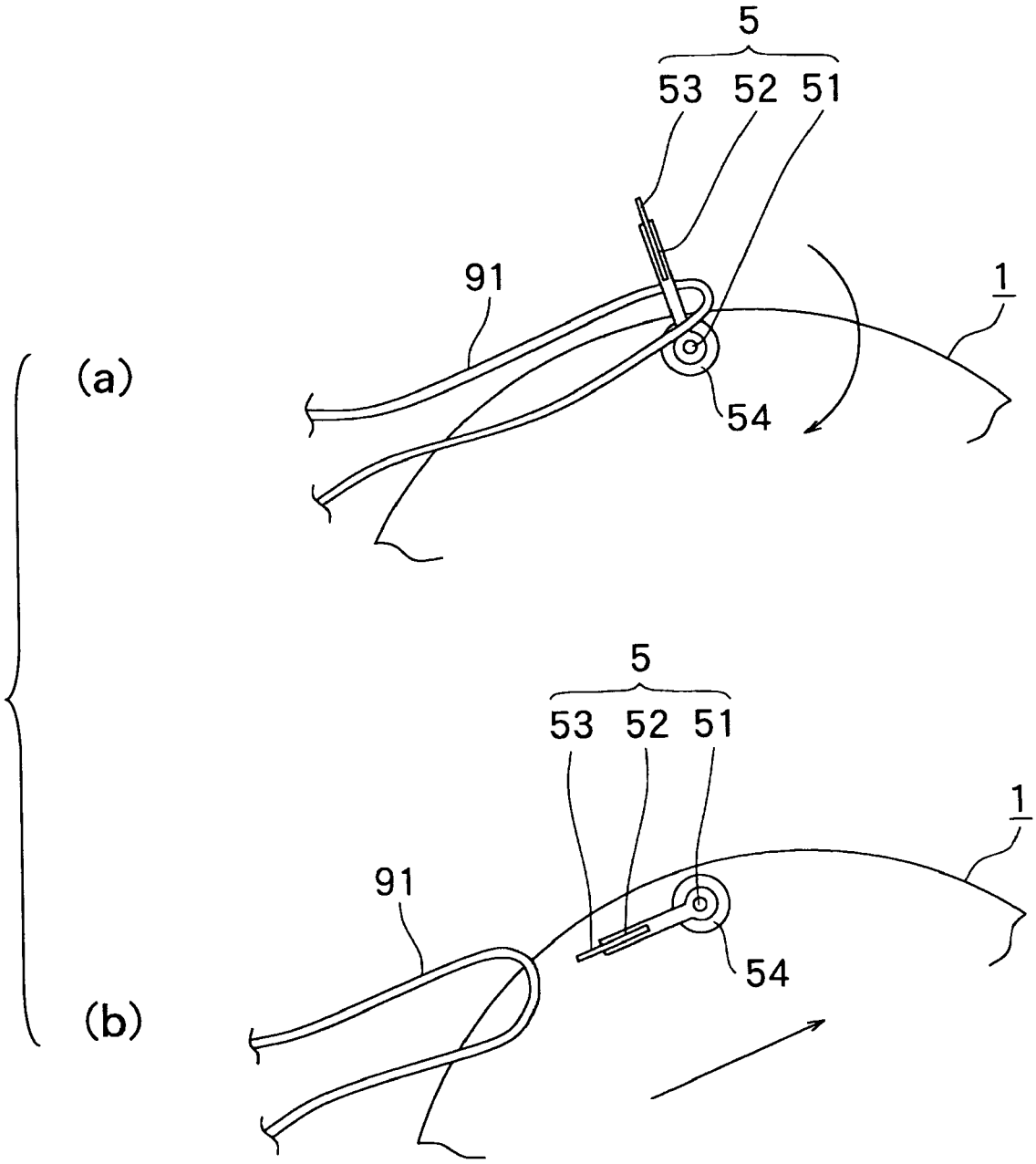
FIG. 7 is a reverse side view showing how a cord entangled in the brush mechanism is released.
Figure 8:
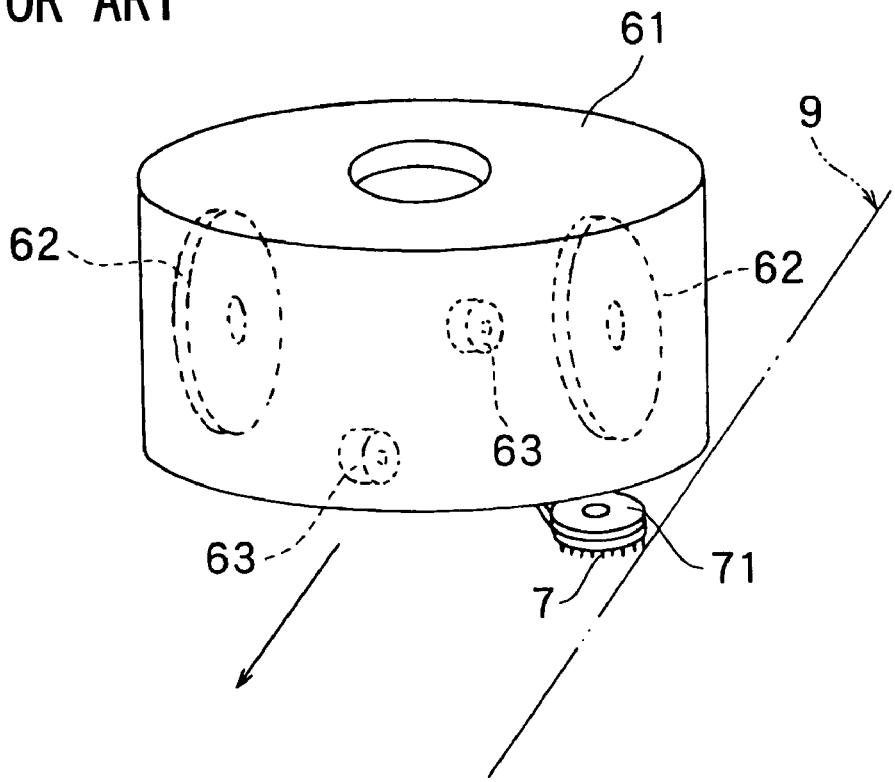
FIG. 8 PRIOR ART
FIG. 8 is a perspective view of a conventional self-traveling cleaner.
Figure 9:
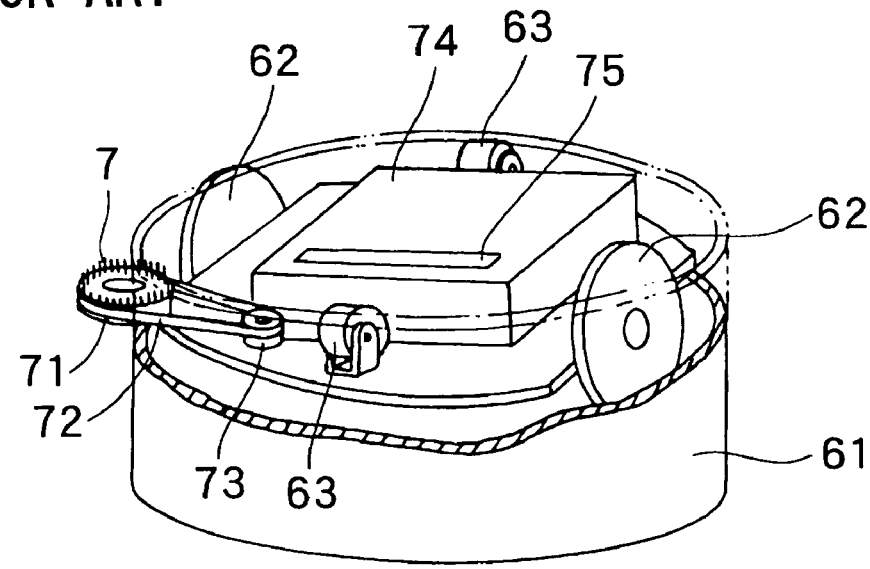
FIG. 9 PRIOR ART
FIG. 9 is a partially broken perspective view showing the self-traveling cleaner reversed.
Figure 10:
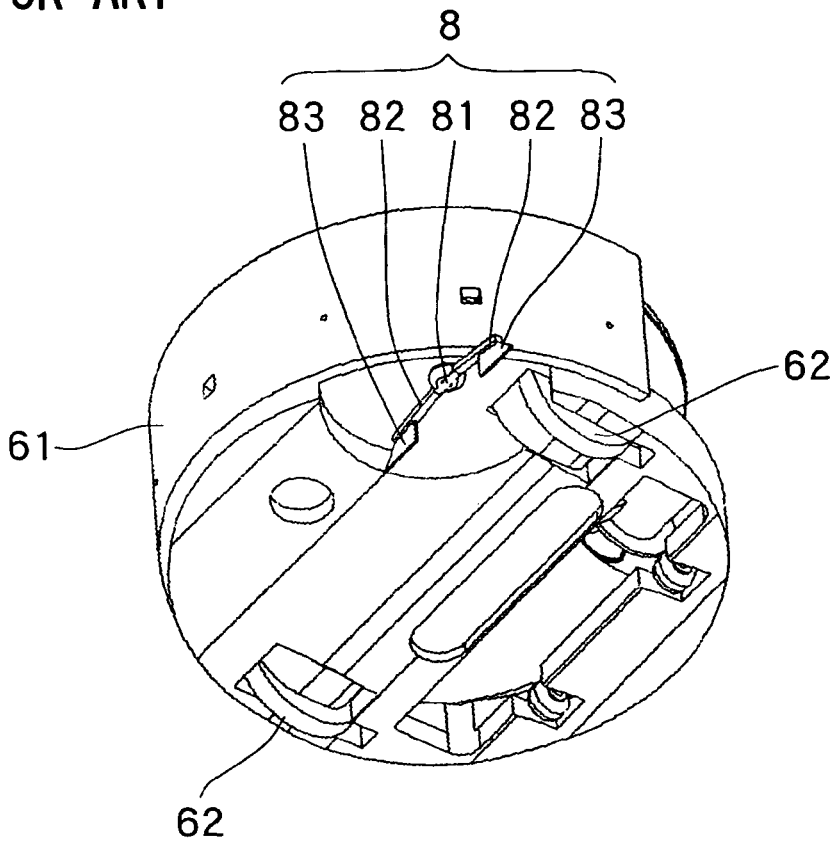
FIG. 10 PRIOR ART
FIG. 10 is a perspective view of another conventional self-traveling cleaner as seen from a reverse side.
Figure 11:
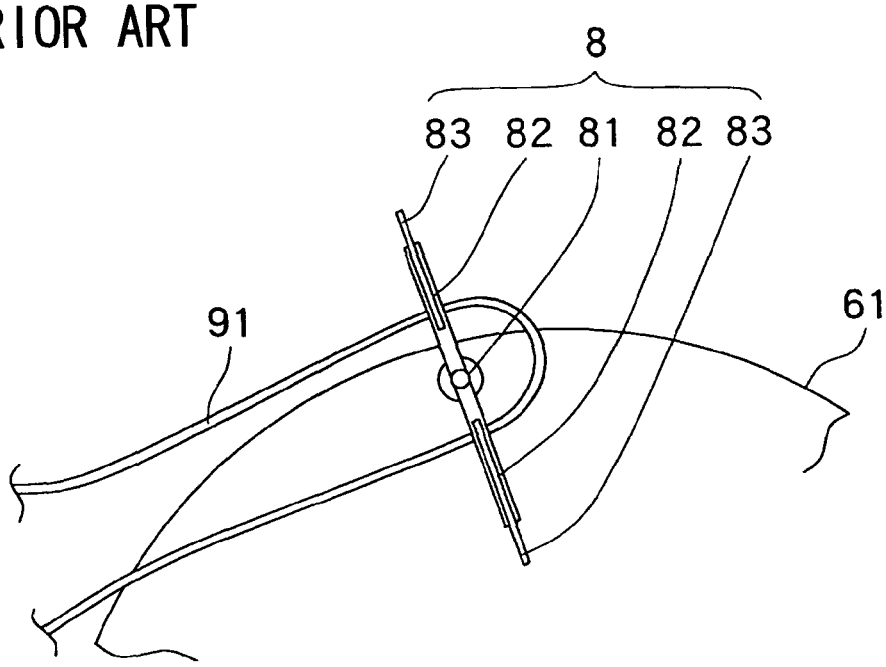
FIG. 11 PRIOR ART
FIG. 11 is a reverse side view showing a cord entangled in a brush mechanism of the self-traveling cleaner.

Furthermore, even if a cord 91 is entangled in the brush mechanism 5 during rotation of the brush mechanism 5 as shown in FIG. 7(*a*), the arm 52 reaches to a rotation angle posture where the entangled cord 91 can be released while rotating one round about the rotation shaft 51 by rotating by approximately 180 degrees as shown in FIG. 7(*b*) from a rotation angle posture where the entangled cord is hooked. Thus, the cord 91 is loosened from the arm 52 of the brush mechanism 5 with self-travel of the main body 1.

Here, because the arm 52 of the brush mechanism 5 is formed from an elastic material, if the arm 52 entangles the cord 91 as shown in FIG. 7(*a*) and great tension acts on the cord 91, the arm 52 curves under the tension. Consequently, the entangled cord 91 can be easily released from the arm 52.

Furthermore, the driving mechanism 4 has the slip mechanism 44. If the brush mechanism 5 entangles the cord or the like, or if the brush mechanism 5 crashes against an obstacle, the brush mechanism 5 is subjected to a greater load, which causes a slip between the first rotor 45 and the second rotor 46 of the slip mechanism 44. An overload exceeding a predetermined value can stop rotation of the second rotor 46 with only the first rotor 45 remaining rotating, to interrupt the power transmission path. Therefore, it can be avoided that the motor 40 is subjected to the overload and the motor 40 burns out.

Furthermore, because the rotation shaft 51 of the brush mechanism 5 has the lower end formed with the curved surface 54 convex toward the floor surface, when the arm 52 releases the cord 91 as shown in FIG. 7(*b*) in the case where the cord 91 is entangled in the arm 52 as shown in FIG. 7(*a*), the cord 91 is guided by the convex surface 54 and smoothly loosened from the arm 52.

As described above, according to the self-traveling cleaner of the present invention, the brush mechanism 5 is subjected to a small load by the floor surface, and the brush mechanism 5 is prevented from entangling the cord or the like and interfering with self-travel.

The present invention is not limited to the above embodiment in construction but can of course be modified variously without departing from the spirit of the invention as set forth in the appended claims. For example, the arm 52 of the brush mechanism 5 may include arm portions extending in two directions forming a V-shape, and respective brushes planted on the arm portions. The arm 52 also may be in a fan-shape with an enlarged end portion and have a brush planted on the arm in the fan-shape. Same effect as in the above-described embodiment can be obtained in such constructions. Moreover, the slip mechanism 44 of the driving mechanism 4 may be in various structures conventionally known. For example, the slip mechanism can be realized with motor current control.

What is claimed is:

1. A self-traveling cleaner comprising a main body having a self-traveling mechanism and a cleaning mechanism, the self-traveling cleaner moving on a floor surface with the self-traveling mechanism and cleaning the floor surface with the cleaning mechanism, the cleaning mechanism comprising a brush mechanism rotatable along the floor surface and a driving mechanism for rotatingly driving the brush mechanism, the brush mechanism comprising a rotation shaft having a base end connected to the driving mechanism and extending perpendicular or approximately perpendicular to the floor surface, only a single arm projecting radially, outwardly, from a lower end, opposite the base end, of the rotation shaft, and a brush disposed on the arm, the rotation shaft being arranged on a lateral side of the main body with respect to a travelling direction of the main body.

2. The self-traveling cleaner according to claim 1, wherein the rotation shaft of the brush mechanism is provided within a reverse side of the main body, and the arm of the brush mechanism has a rotation angle range in which the arm projects outwardly from an outer periphery of the main body and a rotation angle range in which the arm is contained within the outer periphery of the main body, the reverse side of the main body having an inlet of a dust collector.

3. The self-traveling cleaner according to claim 1, wherein the arm of the brush mechanism is formed from an elastic material.

4. The self-traveling cleaner according to claim 1, wherein the driving mechanism has interposed on a power transmission path to the brush mechanism a slip mechanism for interrupting the power transmission path when an overload acts exceeding a load acting on the brush by the floor surface.

5. The self-traveling cleaner according to claim 1, wherein the lower end of the rotation shaft of the brush mechanism has a face opposed to the floor surface, wherein the face is formed with a curved surface, convex toward the floor surface.

* * * * *